US007645164B1

(12) United States Patent
Ju

(10) Patent No.: US 7,645,164 B1
(45) Date of Patent: Jan. 12, 2010

(54) ELECTRICAL CONNECTOR

(75) Inventor: Ted Ju, Keelung (TW)

(73) Assignee: Lotes Co., Ltd, Keelung (TW)

( * ) Notice: Subject to any disclaimer, the term of this patent is extended or adjusted under 35 U.S.C. 154(b) by 0 days.

(21) Appl. No.: 12/268,637

(22) Filed: Nov. 11, 2008

(30) Foreign Application Priority Data

Jul. 1, 2008 (CN) ..... 2008 2 0119165 U

(51) Int. Cl.
*H01R 13/40* (2006.01)

(52) U.S. Cl. ..... 439/591; 439/66

(58) Field of Classification Search ..... 439/91, 439/66, 591

See application file for complete search history.

(56) References Cited

U.S. PATENT DOCUMENTS 5,362,241 A * 11/1994 Matsuoka et al. ..... 439/591
5,938,451 A * 8/1999 Rathburn ..... 439/66
6,176,708 B1 * 1/2001 Michiya ..... 439/66
6,776,624 B2 * 8/2004 Suematsu ..... 439/91
7,165,975 B2 * 1/2007 Hasegawa et al. ..... 439/66

* cited by examiner

*Primary Examiner*—Briggitte R Hammond
(74) *Attorney, Agent, or Firm*—Ming Chow; Sinorica, LLC

(57) ABSTRACT

An electrical connector is revealed. The electrical connector includes an insulating body with at least one terminal receiving hole and an accommodation space disposed on one side of the terminal receiving hole, at least one conductive terminal set that is received in the terminal receiving hole and having a first conductive terminal and a second conducive terminal, and at least one elastic member. The first conductive terminal is connected with the second conductive terminal slidingly and slantingly and the sliding stroke of the first conductive terminal is between the terminal receiving hole and the accommodation space. Each elastic member is correspondingly mounted in one of the accommodation spaces for elastically supporting the first conductive terminal. That means each elastic member gives the first conductive terminal a horizontal lateral force so that the first conductive terminal always applies a normal pressure to the second conductive terminal. Thus the good contact between the two conductive terminals is ensured.

22 Claims, 7 Drawing Sheets

ELECTRICAL CONNECTOR

BACKGROUND OF THE INVENTION

1. Field of Invention

The present invention relates to an electrical connector, especially to an electrical connector that electrically connects a first connecting electronic element with a second connecting electronic element.

2. Description of Related Art

A lot of electronic elements are connected with others by electrical connectors. The most common one available in the connector industry includes an insulating seat and an insulating cap matching with each other, a first terminal, a second terminal and a compression spring received in an receiving hole of the insulating seat. The first terminal and the second terminal are respectively arranged on two ends of the compression spring while the connection end exposes out of the insulating seat and the insulating cap to perform signal transmission.

However, such connector requires improvements. The two ends of the compression spring lean against the first terminal and the second terminal respectively so that the current varies and further has negative effects on stability of signal transmission. Moreover, the first and the second terminals are respectively arranged on two ends of the compression spring. In order to make the spring extends and retracts elastically, the receiving holes for accommodating the first terminal, the second terminal and the compression spring are made to be a bit larger. This makes the contact of the first terminal with the second terminal is not tight and furthermore the normal force of the contact area of the first terminal with the second terminal is smaller while the contact resistance thereof is larger. In addition, when the action force of the connecting electronic element in the electrical connector is over, the direction of the elastic retraction is uncertain so that the contact position between the first terminal and the second terminal is away from normal position. This has an effect on the electrical connection between the electrical connector and the connecting electronic element and the stability of signal transmission is further affected.

Thus there is a need to design a novel electrical connector for overcoming above shortcomings.

SUMMARY OF THE INVENTION

Therefore it is a primary object of the present invention to provide an electrical connector providing stable communication performance.

An electrical connector electrically connecting a first connecting electronic element with a second connecting electronic element according to the present invention includes an insulating body, at least one conductive terminal set, and at least one elastic member. The insulating body is disposed with at least one terminal receiving hole and an accommodation space disposed on one side of each terminal receiving hole. The conductive terminal set is received in the terminal receiving hole and having a first conductive terminal correspondingly connected with the first connecting electronic element and a second conducive terminal correspondingly connected with the second connecting electronic element. The first conductive terminal is connected with the second conductive terminal slidingly and slantingly while the sliding stroke of the first conductive terminal is between the terminal receiving hole and the accommodation space. Each elastic member is correspondingly mounted in one of the accommodation spaces for elastically supporting the first conductive terminal.

The electrical connector of the present invention connecting a first connecting electronic element with a second connecting electronic element includes an insulating body with at least one terminal receiving hole and at least one accommodation space laterally connected with the terminal receiving hole, at least one conductive terminal set, and at least one elastic member. The conductive terminal set is received in the terminal receiving hole and having a first conductive terminal correspondingly connected with the first connecting electronic element and a second conducive terminal correspondingly connected with the second connecting electronic element. The first conductive terminal includes a first connecting part and a first inclined contact surface that connects with the second conductive terminal is formed on one side of the first connecting part. The elastic member is correspondingly mounted in the accommodation space. Each elastic member attaches firmly to one side of the first conductive terminal, opposite to the first inclined contact surface.

Compared with the prior art, one side of the terminal receiving hole of the insulating body of the electrical connector according to the present invention is disposed with an accommodation space and the first conductive terminal connects with the second conductive terminal slidingly and slantingly while the sliding stroke of the first conductive terminal is between the terminal receiving hole and the accommodation space. Each elastic member is correspondingly received in one of the accommodation spaces for elastically supporting one of the first conductive terminals. Each elastic member applies a lateral pushing force in the horizontal direction to the first conductive terminal. The lateral pushing force in the horizontal direction makes the first conductive terminal apply a positive pressure to the second conductive terminal so as to reduce the contact resistance between the two conductive terminals of each conductive terminal set. Therefore, good contact between the two conductive terminals is verified.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENT

Figure 1:
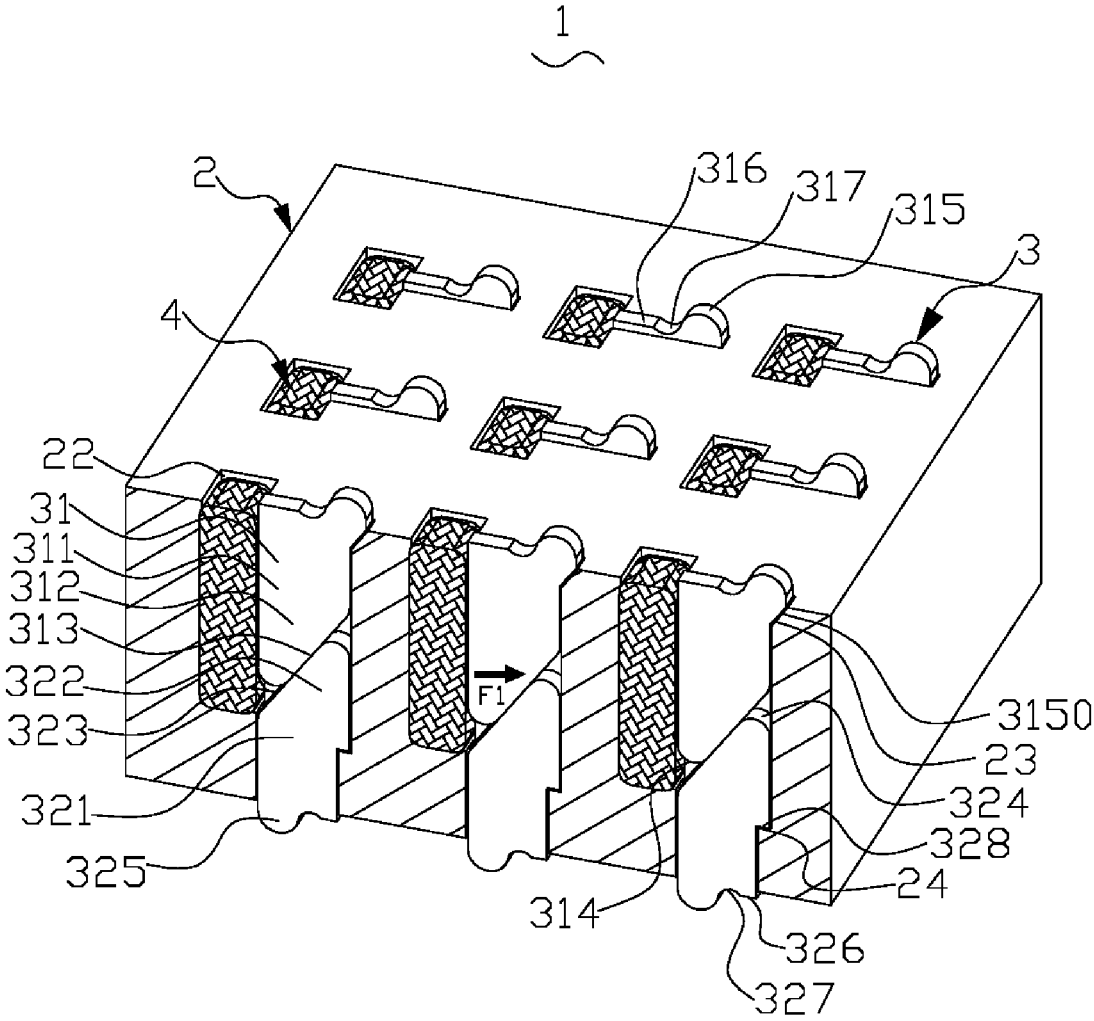
FIG. 1 is a partial perspective view of an embodiment of an electrical connector according to the present invention.
Figure 2:
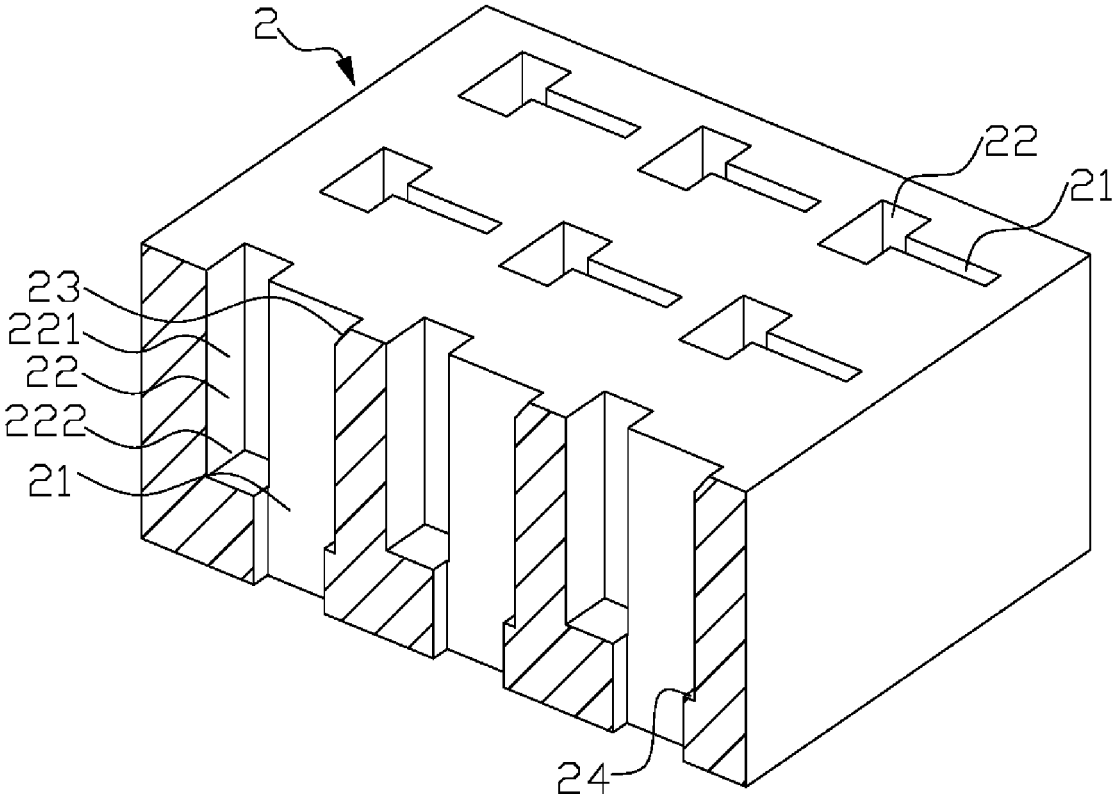
FIG. 2 is a partial perspective view of an insulating body of the embodiment in FIG. 1 according to the present invention.
Figure 3:
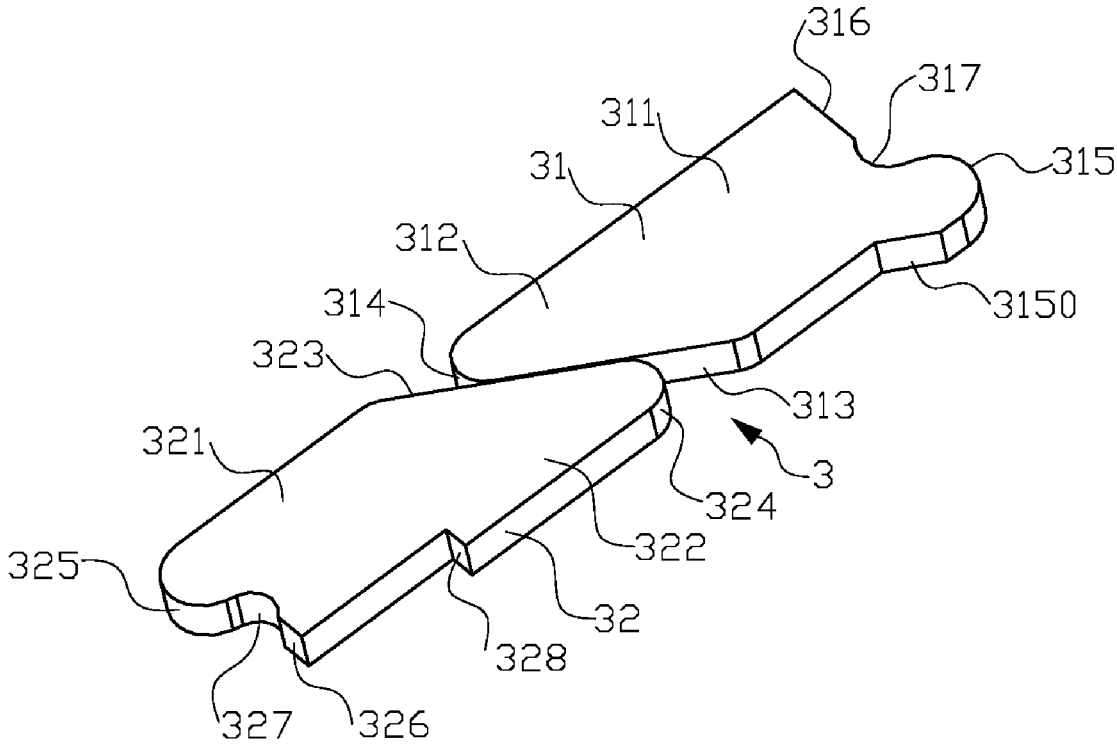
FIG. 3 is a perspective view of conductive terminals of the embodiment in FIG. 1 according to the present invention.
Figure 4:
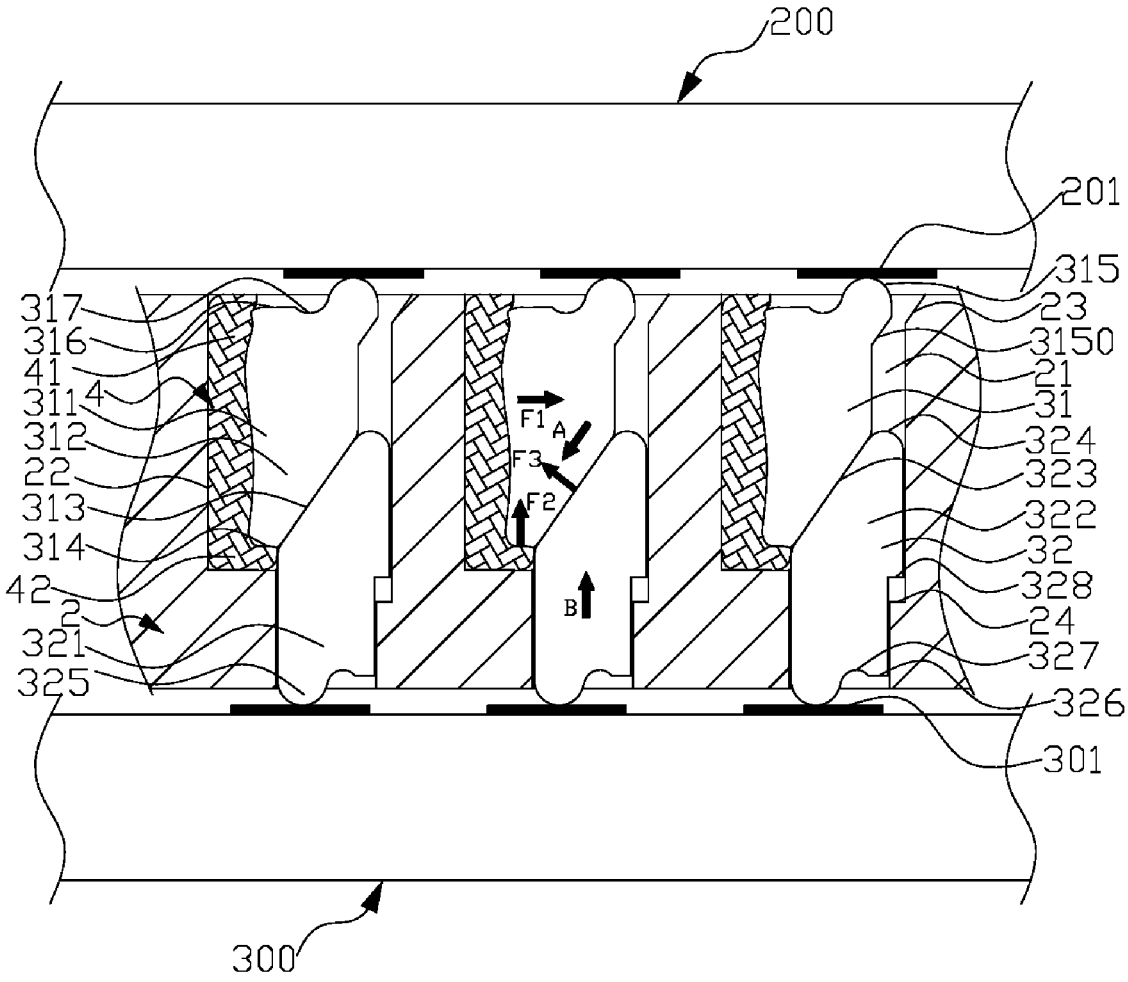
FIG. 4 is a partial cross sectional view of the embodiment in FIG. 3 assembled with a first connecting electronic element and a second connecting electronic element.

Refer from FIG. 1 to FIG. 4, an electrical connector 1 for electrically connecting a first connecting electronic element 200 with a second connecting electronic element 300. As shown in FIG. 4, the first connecting electronic element 200 includes at least a first contact area 201 while the second electronic element 300 includes at least a second contact area 301. Refer to FIG. 1, the electrical connector 1 includes an insulating body 2, at least one conductive terminal set 3 and at least one elastic member 4. The conductive terminal set 3 is formed by a first conductive terminal 31 and a second conductive terminal 32 while both the conductive terminal set 3 and the elastic member 4 are received in the insulating body 2.

As shown in FIG. 1, FIG. 2 and FIG. 4, the insulating body 2 is a plate made from plastic that is not easy to cause deformation. The insulating body 2 is disposed with a terminal receiving hole 21 for receiving the conductive terminal set 3 and the terminal receiving hole 21 penetrate top and bottom surfaces of the insulating body 2. An accommodation space 22 in the insulating body 2 is disposed on one side of the terminal receiving hole 21. That means inside the insulating body 2, there is at least one accommodation space 22 connects with the terminal receiving hole 21 laterally. The accommodation space 22 includes a main space 221 and a sliding space 222. A second inclined plane 23 is disposed on top part of one side of the terminal receiving hole 21, opposite to the accommodation space 22 and a holding part 24 is arranged on bottom of the terminal receiving hole 21 of the insulating body 2.

As shown from FIG. 2 to FIG. 4, the above mentioned first conductive terminal 31 of the conductive terminal set 3 has similar shape and structure to the second conductive terminal 32. Both the first conductive terminal 31 and the second conductive terminal 32 are non-elastic plate-shaped bodies without any bending. While in usage, the non-elastic plate-shaped body is not deformed so that the mechanical property is not an important thing in selecting material. Thus the material of the first conductive terminal 31 and the second conductive terminal 32 can be high conductivity pure (red) copper or other metals with good conductivity. Therefore, the conductive terminal set 3 has good conductivity. The first conductive terminal 31 is connected with the second conductive terminal 32 slidingly and slantingly. The sliding stroke of the first conductive terminal 31 is between the terminal receiving hole 21 and the accommodation space 22. Each first conductive terminal 31 includes a first main body 311 while a first connecting part 312 extends from one end of the first main body 311 and a first inclined contact surface 313 is formed on one side of the first connecting part 312. Each second conductive terminal 32 includes a second main body 321 while a second connecting part 322 extends from one end of the second main body 321 and a second inclined contact surface 323 is formed on one side of the second connecting part 322. The first inclined contact surface 313 and the second inclined contact surface 323 connect and contact with each other. In this embodiment, the inclined contact surface 313 (323) is a rectangular plane so as to make the contact area of first connecting part 312 with the second connecting part 322 become larger. Moreover, when the first conductive terminal 31 and the second conductive terminal 32 are in relative motion along the inclined contact surface 313 (323), the two inclined contact surfaces 313, 323 will not scratch or damage each other. Therefore, the conductive terminal set maintains good electrical connection. As shown in FIG. 3, a first end 314 and a second end 324 are respectively arranged on a rear end of the first connecting part 312 and the second connecting part 322. The first end 314 and the second end 324 are arc-shaped so that the two inclined contact surfaces 313, 323 will not scratch each other and the good electrical connection of the conductive terminal set 3 is maintained while the first conductive terminal 31 and the second conductive terminal 32 are in relative motion along the inclined contact surfaces 313, 323. A first contact part 315 that electrically connects with the first contact area 201 of the first connecting electronic element 200 extends from top of the first main body 311 and exposes out of the insulating body 2. A first inclined plane 3150 is located on one side of the first conductive terminal 31, beside the first contact part 315. And the second main body 321 extends downward to form a second contact part 325 that electrically connects with the second contact area 301 of the second connecting electronic element 300 and exposes out of the insulating body 2. The above mentioned first contact part 315 of the first conductive terminal 31 and the second contact part 325 of the second conductive terminal 32 face in opposite directions. Such design is mainly for matching the inclined contact surface. When at least one conductive terminal is compressed, the first inclined contact surface 313 of the first conductive terminal 31 is forced to contact with the second inclined contact surface 323 of the second conductive terminal 32 more closely. Each conductive terminal (the first conductive terminal 31 and the second conductive terminal 32) includes a contact part (the first and the second contact part 315, 325) projecting out of the insulating body 2 respectively. At the same time, a first material belt connecting part 316 and a second material belt connecting part 326 is arranged on one side of the conductive terminals 31, 32, lower than the contact parts 315, 325 while a first concavity 317 and a second concavity 327 are between the contact part 315, 325 and the material belt connecting parts 316, 326. In this embodiment, at least one shoulder part 328 that hooks with the holding part 24 of the insulating body 2 is disposed on one side of the second conductive terminal 32, beside the second material belt connecting part 326. The shoulder part 328 can also disposed on one side of the second contact part 325, the contact part 321 or the second connecting part 322.

As shown from FIG. 1 to FIG. 4, a plurality of the elastic members 4, Each elastic member includes a first elastic part 41 located in the main space 221 and a second elastic part 42 located in the sliding space 222. When the first conductive terminal 31 connects with the first connecting electronic element 200, the first connecting electronic element 200 applied a pressure so that the first conductive terminal 31 moves horizontally and down, sliding to connect the second conductive terminal 32 slantingly. And the first conductive terminal 31 is compressed into the main space 221 and the sliding space 222 to press the first elastic part 41 and the second elastic part 42. The first elastic part 41 retracts and gives the first conductive terminal 31 a horizontal lateral pushing force F1 while the second elastic part 42 retracts and gives the first end 314 at least one upward elastic supporting force F2 (also including a horizontal force). The lateral pushing force F1 makes the first inclined contact surfaces 313 of the first conductive terminal 31 apply a normal (positive) pressure to the second inclined contact surfaces 323 of the second conductive terminal 32 so as to reduce the contact resistance between the two inclined contact surfaces 313, 323. Moreover, such design also makes the first connecting part 312 of the first conductive terminal 31 keep in good contact with the second connecting part 322 of the second conductive terminal 32. The second conductive terminal 32 gives the first conductive terminal 31 a supporting force F3 along the direction perpendicular to the second inclined contact surface 323. A resultant force of the lateral pushing force F1 and the supporting force F3 act upwards on the first conductive terminal 31 while the elastic supporting force F2 also acts on the first conductive terminal 31. Thus the resultant force of the lateral pushing force F1 and the supporting force F3 as well as the elastic supporting force F2 acts jointly on the first conductive terminal 31 so as to make the first conductive terminal 31 connect better with the first connecting electronic element 200.

As shown from FIG. 1 to FIG. 4, when the electrical connector 1 connecting the first connecting electronic element 200 with the second connecting electronic element 300, the first conductive terminal 31 and the second conductive terminal 32 respectively connects with the first connecting electronic element 200 and the second connecting electronic element 300. When the first connecting electronic element 200 connects with the first conductive terminal 31, the first inclined plane 3150, beside the first contact part 315, of the first conductive terminal corresponds to the second inclined plane 23 on top part of one side of the terminal receiving hole 21, opposite to the accommodation space 22 of the insulating body 2 and there is a friction between the two inclined planes 3150, 23 while the first inclined plane 3150 attaches and moves along the second inclined plane 23. Thus the first terminal 31 moves horizontally and down simultaneously, as indicated by an arrow A in FIG. 4. At least part of the first conductive terminal 31 enters into the accommodation space 22 and one side of the first conductive terminal 31 opposite to the first inclined plane 3150 presses the elastic member 4. That means the first conductive terminal 31 only moves in a specific direction and the direction as well as the distance of the movement is easy to be predicted and controlled. Furthermore, the first conductive terminal 31 have a scratch action for removing oxide aimed at the first contact area 201 of the first connecting electronic element 200 so as to maintain good electrical connection between the first conductive terminal 31 and the first connecting electronic element 200.

Moreover, when the electrical connector 1 electrically connects with the first connecting electronic element 200 and the second connecting electronic element 300, the elastic member 4 applies a horizontal lateral pushing force F1 to the first conductive terminal 31 so that the first inclined contact surfaces 313 of the first conductive terminal 31 applies a normal (positive) pressure to the second inclined contact surfaces 323 of the second conductive terminal 32 and the first conductive terminal 31 moves horizontally and down simultaneously. That means the first conductive terminal 31 sliding sideways. The second conductive terminal 32 moves upward. Thus the first inclined contact surface 313 of the first conductive terminal 31 is forced to contact with the second inclined contact surface 323 of the second conductive terminal 32 more closely and the contact resistance between the two inclined contact surfaces 313, 323 is reduced. Therefore, the first connecting part 312 of the first conductive terminal 31 keeps in good contact with the second connecting part 322 of the second conductive terminal 32.

Furthermore, when the electrical connector 1 electrically connects the first connecting electronic element 200 with the second connecting electronic element 300, the first conductive terminal 31 moves horizontally and down while the second conductive terminal 32 moves upward (as indicated by an arrow B in FIG. 4) so that the contacted first conductive terminal 31 and the second conductive terminal 32 are in relative motion along the inclined contact surfaces 313, 323 until the contact area of the first inclined contact surface 313 with the second inclined contact surface 323 achieves the maximum. This also leads to resistance reduction.

The resistance of the present invention keeps below the preset standard value so as to ensure smooth current transfer and provide stable, clear communication performance.

The first conductive terminal 31 presses the first elastic part 41 in the main space 221 as well as the second elastic part 42 in the sliding space 222 so that the first elastic part 41 retracts and applies a horizontal lateral pushing force F1 to the first conductive terminal 31 and the second elastic part 42 retracts and applies an upward elastic supporting force F2 as well as a horizontal force to the first end 314. When the first connecting electronic element 200 and the second connecting electronic element 300 are released from each other, the first conductive terminal 31 turns back to the original position by the pushing force F1 from the first elastic part 41 and the elastic supporting force F2 as well as the horizontal force from the second elastic part 42. Through the action of the first conductive terminal 31, the second conducive terminal 32 also turns back to the original position (not shown in figure).

Figure 5:
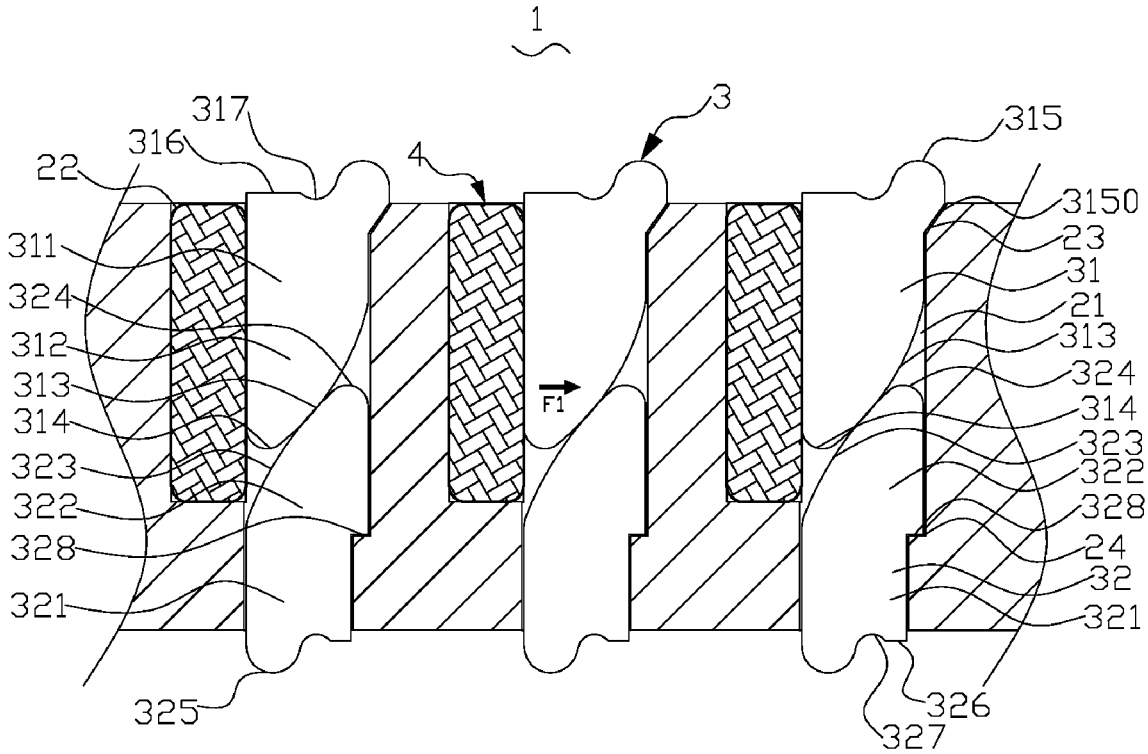
FIG. 5 is a partial cross sectional view of another embodiment according to the present invention.

Refer to FIG. 5, another embodiment is disclosed. The difference between this embodiment (the second) of the electrical connector and the above embodiment is in that a first inclined contact surface 313 and a second inclined contact surface 323 of this embodiment are curved surfaces that increases contact surface between the first connecting part 312 and the second connecting part 322. Moreover, when the first conductive terminal 31 and the second conductive terminal 32 are in relative motion along the inclined contact surfaces 313, 323, the inclined contact surfaces 313, 323 will not scratch and damage each other so as to ensure good electrical connection of the conductive terminal set. This embodiment also achieves the same objects and effects as the foresaid embodiment.

Figure 6:
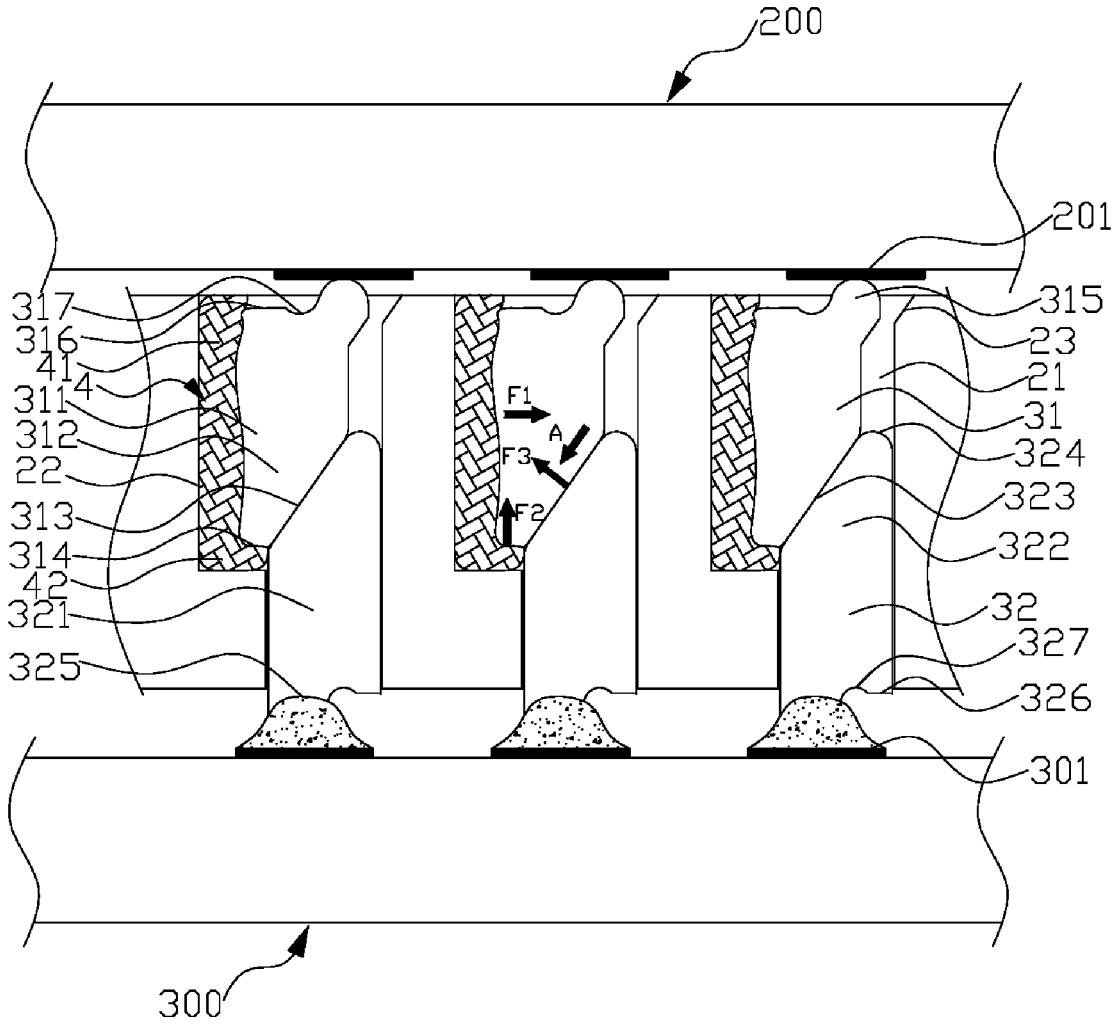
FIG. 6 is a partial cross sectional view of the third embodiment according to the present invention assembled with a first connecting electronic element and a second connecting electronic element.

Refer to FIG. 6, the third embodiment is revealed. The difference between this embodiment of the electrical connector 1 and the first embodiment is in that the electrical connector 1 is welded on the second connecting electronic element 300. That means the second conductive terminal 32 connects with the second connecting electronic element 300 by welding. At least one shoulder part 328 that locks with the holding part 24 of the insulating body 2 is disposed on one side of the second conductive terminal 32 of the conductive terminal set 3, beside the second material belt connecting part 326. Without the shoulder part 328, this embodiment can also achieves the same objects and effects as the first embodiment.

Figure 7:
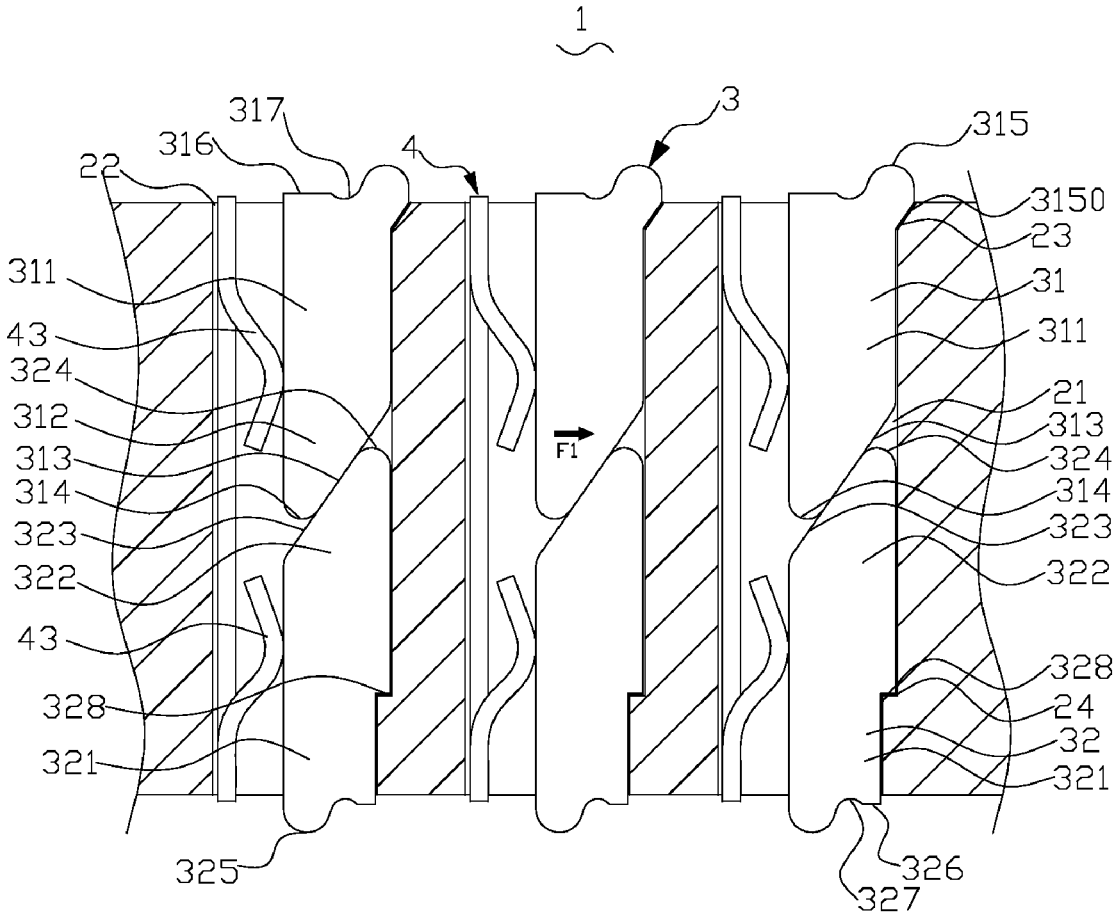
FIG. 7 is a partial cross sectional view of the fourth embodiment according to the present invention.

Refer to FIG. 7, the fourth embodiment is revealed. The difference between this embodiment of the electrical connector 1 and the first embodiment is in that the elastic member 4 is an elastic metal piece 4. At least one elastic unit 43 extends horizontally from one side of the elastic metal piece 4 for electrically connecting with the first conductive terminal 31. In this embodiment, the elastic unit 43 is an elastic arm 43. Similarly, there may be two elastic units 43 that extends horizontally from the elastic metal piece 4 so as to electrically contact the first conductive terminal 31 and the second conductive terminal 32 respectively.

In summary, the electrical connector 1 of the present invention has the following advantages:

1. In the electrical connector 1, the first conductive terminal 31 and the second conductive terminal 32 are non-elastic plate-shaped bodies without any bending part. While being operated, the non-elastic plate-shaped body is not deformed so that mechanical properties of material is not an important factor in material selection. Thus the material of the first conductive terminal 31 and the second conductive terminal 32 can be high conductivity pure (red) copper or other metals with good conductivity. Therefore, the conductive terminal set 3 has good conductivity.

2. The insulating body 2 of the electrical connector 1 is made from plastic that is not easy to cause deformation. Each accommodation space 22 is laterally connected with one side of the terminal receiving hole 21 and each elastic member 4 is located into one accommodation space 22 correspondingly. Each elastic member 4 at least applies a horizontal force to the conductive terminal set 3 (especially the first conductive terminal 31). A first inclined plane 3150 is disposed on one side of the first conductive terminal 31, beside the first contact part 315 and a second inclined plane 23 is disposed on top part of one side of the terminal receiving hole 21, opposite to the accommodation space 22. Thus when the electrical connector 1 connects the first connecting electronic element 200 with the second connecting electronic element 300, the first connecting electronic element 200 contacts with the first conductive terminal 31 so that the first inclined plane 3150 moves along the inclined plane 23. That means the first terminal 31 moves horizontally and down simultaneously so that part of the first conductive terminal 31 enters into the accommodation space 22 and one side of the first conductive terminal 31 opposite to the first inclined plane 3150 presses the elastic member 4. That means the first conductive terminal 31 only moves in a specific direction and the direction as well as the distance of the movement of the conductive terminal set 3 (especially the first conductive terminal 31) is easy to be predicted and controlled.

3. When the first conductive terminal 31 connects with the first connecting electronic element 200, the first elastic part 41 retracts and gives the first conductive terminal 31 a horizontal lateral pushing force F1 while the second elastic part 42 also retracts and gives the first end 314 an upward elastic supporting force F2. The lateral pushing force F1 makes the first inclined contact surfaces 313 of the first conductive terminal 31 apply a normal (positive) pressure to the second inclined contact surfaces 323 of the second conductive terminal 32 so as to reduce the contact resistance between the two inclined contact surfaces 313, 323. Thus it is ensured that the first connecting part 312 of the first conductive terminal 31 and the second connecting part 322 of the second conductive terminal 32 are in good contact. The second conductive terminal 32 gives the first conductive terminal 31 a supporting force F3 along the direction perpendicular to the second inclined contact surface 323. Therefore, the horizontal lateral pushing force F1, the supporting force F3 and the aforesaid upward elastic supporting force F2 act jointly on the first conductive terminal 31 so as to make the first conductive terminal 31 connect easily and well with the first connecting electronic element 200.

4. When the electrical connector 1 of the present invention electrically connects with the first connecting electronic element 200 and the second connecting electronic element 300, the elastic member 4 applies a lateral pushing force F1 in the horizontal direction to the first conductive terminal 31 so that the first inclined contact surface 313 of the first conductive terminal 31 applies a normal (positive) pressure to the second inclined contact surface 323 of the second conductive terminal 32 and the first conductive terminal 31 moves horizontally and down simultaneously. The second conductive terminal 32 moves upward to force the first inclined contact surface 313 of the first conductive terminal 31 to contact with the second inclined contact surface 323 of the second conductive terminal 32 more closely and the contact resistance between the two inclined contact surfaces 313, 323 is reduced. Therefore, the first connecting part 312 of the first conductive terminal 31 keeps in good contact with the second connecting part 322 of the second conductive terminal 32.

5. When the electrical connector 1 of the present invention electrically connects the first connecting electronic element 200 with the second connecting electronic element 300, the first conductive terminal 31 moves horizontally and down and the second connecting electronic element 300 connects with the second conductive terminal 32 while the second conductive terminal 32 moves upward so that the first conductive terminal 31 and the second conductive terminal 32, contacting with each other, are in relative motion along the inclined contact surfaces until the contact area of the first inclined contact surface 313 with the second inclined contact surface 323 achieves the maximum. Thus the purpose of resistance reduction is achieved.

6. In the electrical connector 1 of the present invention, the first conductive terminal 31 presses the first elastic part 41 in the main space 221 as well as the second elastic part 42 in the sliding space 222 so that the first elastic part 41 retracts and applies a horizontal lateral pushing force F1 to the first conductive terminal 31 and the second elastic part 42 retracts and applies an upward elastic supporting force F2 as well as a horizontal force to the first end 314. When the first connecting electronic element 200 and the second connecting electronic element 300 are released from each other, the first conductive terminal 31 turns back to the original position by the pushing force F1 from the first elastic part 41 and the elastic supporting force F2 as well as the horizontal force from the second elastic part 42. Through the action of the first conductive terminal 31, the second conducive terminal 32 also turns back to the original position.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. An electrical connector for electrically connecting a first connecting electronic element with a second connecting electronic element, comprising:

an insulating body with at least one terminal receiving hole and an accommodation space disposed on one side of the terminal receiving hole inside the insulating body, the accommodation space including a main space, the main space extending downward to form a sliding space;

at least one conductive terminal set that is correspondingly received in the terminal receiving hole; each conductive terminal set having a first conductive terminal correspondingly connected with the first connecting electronic element and a second conducive terminal correspondingly connected with the second connecting electronic element; the first conductive terminal connected with the second conductive terminal slidingly and slantingly, the first conductive terminal moving in the main space along a sliding stroke, the sliding stroke of the first conductive terminal being between the terminal receiving hole and the accommodation space; and at least one elastic member that is correspondingly received in the accommodation space and is for elastically supporting the first conductive terminal, the elastic member including a first elastic part, the first elastic part extending downward to form a second elastic part while the first elastic part located in the main space and the second elastic part located in the sliding part, the first elastic part applying a lateral pushing force to the first conductive terminal, the first conductive terminal moving in the main space of the accommodation space along the sliding stroke, the second elastic part providing the first conductive terminal at least one upward elastic supporting force.

2. The electrical connector as claimed in claim 1, wherein at least one conductive terminal of the conductive terminal set is disposed with an inclined contact surface for slantingly connects with another conductive terminal.

3. The electrical connector as claimed in claim 2, wherein the inclined contact surface is a curved surface.

4. The electrical connector as claimed in claim 1, wherein at least one conducive terminal of the conductive terminal set is a plate-shaped body.

5. The electrical connector as claimed in claim 1, wherein at least one conducive terminal of the conductive terminal set is a non-elastic plate-shaped body.

6. The electrical connector as claimed in claim 5, wherein the conductive terminal is made of high conductivity pure copper.

7. The electrical connector as claimed in claim 1, wherein when the first connecting electronic element connects with the first conductive terminal, the first conductive terminal moves horizontally and downwards simultaneously while when the second connecting electronic element connects with the second conductive terminal, the second conductive terminal moves upward.

8. The electrical connector as claimed in claim 1, wherein the elastic member is made of rubber.

9. The electrical connector as claimed in claim 1, wherein the elastic member is an elastic metal piece.

10. The electrical connector as claimed in claim 1, wherein one end of at least one conductive terminal of the conductive terminal set is disposed with a first contact part that projects out of the insulating body and a material belt connecting part being positioned lower than the contact part, the first contact part is electrically connecting the first connecting electronic element.

11. The electrical connector as claimed in claim 1, wherein one end of the second conductive terminal is disposed with a second contact part projecting out of the insulating body, and a material belt connecting part being positioned lower than the second contact part, and at least one shoulder part that hooks with the insulating body, the second contact part is electrically connecting the first connecting electronic element.

12. An electrical connector for electrically connecting a first connecting electronic element with a second connecting electronic element, comprising:

an insulating body having at least one terminal receiving hole and at least one accommodation space laterally connected with the terminal receiving hole;

at least one conductive terminal set that is correspondingly received in the terminal receiving hole;

the conductive terminal set having a first conductive terminal correspondingly connected with the first connecting electronic element and a second conducive terminal correspondingly connected with the second connecting electronic element; the first conductive terminal having a first connecting part and a first inclined contact surface is formed on one side of the first connecting part for connecting with the second conductive terminal slantingly; and at least one elastic member that is correspondingly received in the accommodation space and the elastic member attaches firmly on one side of the first conductive terminal, opposite to the first inclined contact surface.

13. The electrical connector as claimed in claim 12, wherein the second conductive terminal includes a second connecting part and a second inclined contact surface is formed on one side of the second connecting part while the first inclined contact surface and the second inclined contact surface connects and contacts with each other.

14. The electrical connector as claimed in claim 13, wherein the elastic member faces the second inclined contact surface.

15. The electrical connector as claimed in claim 13, wherein at least one of the inclined contact surfaces—the first inclined contact surface or the second inclined contact surface is a curved surface.

16. The electrical connector as claimed in claim 12, wherein at least one conducive terminal of the conductive terminal set is a non-elastic plate-shaped body.

17. The electrical connector as claimed in claim 16, wherein the conductive terminal is made of high conductivity red copper.

18. The electrical connector as claimed in claim 12, wherein a first inclined plane is disposed on one side of the first conductive terminal and a corresponding second inclined plane is arranged on the insulating body; when the first connecting electronic element presses and connects with the first conductive terminal, there is a friction between the first inclined plane and the second inclined plane while the first inclined plane attaches and moves along the second inclined plane and the first conductive terminal have a scratch action for removing oxide aimed at a contact area of the first connecting electronic element.

19. The electrical connector as claimed in claim 12, wherein the second conductive terminal connects with the second connecting electronic element by welding.

20. The electrical connector as claimed in claim 12, wherein the elastic member is made of rubber.

21. The electrical connector as claimed in claim 12, wherein the elastic member is an elastic metal piece.

22. The electrical connector as claimed in claim 12, wherein one end of at least one conductive terminal of the conductive terminal set is disposed with a contact part that projects out of the insulating body and a material belt connecting part being positioned lower than the contact part, the first contact part is electrically connecting the first connecting electronic element.

* * * * *